US007175404B2

(12) United States Patent
Kondo et al.

(10) Patent No.: US 7,175,404 B2
(45) Date of Patent: Feb. 13, 2007

(54) COMPOSITE POWDER FILLING METHOD AND COMPOSITE POWDER FILLING DEVICE, AND COMPOSITE POWDER MOLDING METHOD AND COMPOSITE POWDER MOLDING DEVICE

(75) Inventors: Mikio Kondo, Aichi (JP); Hiroshi Okajima, Nishikasugai-gun (JP); Yoshitaka Takahashi, Toyota (JP)

(73) Assignees: Kabushiki Kaisha Toyota Chuo Kenkyusho, Aichi-gun (JP); Toyota Jidosha Kabushiki Kaisha, Toyota (JP)

( * ) Notice: Subject to any disclaimer, the term of this patent is extended or adjusted under 35 U.S.C. 154(b) by 113 days.

(21) Appl. No.: 10/475,964

(22) PCT Filed: Mar. 27, 2002

(86) PCT No.: PCT/JP02/03020

§ 371 (c)(1),
(2), (4) Date: Oct. 27, 2003

(87) PCT Pub. No.: WO02/090097

PCT Pub. Date: Nov. 14, 2002

(65) Prior Publication Data

US 2004/0141871 A1 Jul. 22, 2004

(30) Foreign Application Priority Data

Apr. 27, 2001 (JP) ..... 2001-133287

(51) Int. Cl.
*B22F 3/02* (2006.01)

(52) U.S. Cl. ..... 425/78

(58) Field of Classification Search ..... 419/6, 419/7; 425/78
See application file for complete search history.

(56) References Cited

U.S. PATENT DOCUMENTS 3,780,418 A * 12/1973 Hurst ..... 419/42
5,672,313 A * 9/1997 Shiga et al. ..... 264/460
5,672,363 A * 9/1997 Sagawa et al. ..... 425/3
5,881,357 A * 3/1999 Takemoto et al. ..... 419/38
5,897,826 A 4/1999 Lashmore et al.
6,039,221 A * 3/2000 Chatterjee et al. ..... 222/361
6,299,832 B1 * 10/2001 Kohara et al. ..... 419/38
6,325,965 B1 * 12/2001 Makita et al. ..... 419/38

(Continued)

FOREIGN PATENT DOCUMENTS

GB 2233000 A * 1/1991

(Continued)

*Primary Examiner*—Daniel Jenkins
(74) *Attorney, Agent, or Firm*—Oblon, Spivak, McClelland, Maier & Neustadt, P.C.

(57) ABSTRACT

The present invention is an apparatus for filling a multi-powder including a powder box (10) including a plurality of powder chambers storing a plurality of powders whose constituent compositions differ in a divided manner, and a gas feed pipe (14) disposed on the bottom side of the powder chamber and having an introducing hole for introducing a gas, wherein it can fill a plurality of the powders into a cavity (24) at once through the bottom openings of the powder box by introducing a gas through the introducing hole to substantially equalize the respective flow resistances of a plurality of the powders. Thus, it is possible to fill the powders whose constituent compositions differ at once without disposing them in a mixed manner.

12 Claims, 10 Drawing Sheets

U.S. PATENT DOCUMENTS

| | | | | |
|---|---|---|---|---|
| 6,474,371 | B1 * | 11/2002 | Ogawa et al. | 141/67 |
| 6,602,352 | B2 * | 8/2003 | Okumura et al. | 148/103 |
| 6,649,124 | B2 * | 11/2003 | Kohara et al. | 419/38 |

FOREIGN PATENT DOCUMENTS

| | | |
|---|---|---|
| JP | 58-44997 | 3/1983 |
| JP | 5-271703 | 10/1993 |
| JP | 6-14810 | 1/1994 |
| JP | 8-41503 | 2/1996 |
| JP | 9-267195 | 10/1997 |
| JP | 11-104893 | 4/1999 |
| JP | 11-104894 | 4/1999 |
| WO | 01/56726 | 8/2001 |

* cited by examiner

Flow Resistance A = B = C

Flow Resistance A > B > C

Width-wise Dimensional Change Measurment Sections

Composition: Fe-2Cu-0.6C/Fe-2Cu-0.8C+0.8%ZnSt.
Aeration or Filling by Suction & Compacting at 588MPa
Sintering: at 1150 ℃ for 30 min. in $N_2$ & 100 ℃/min. Cooling

COMPOSITE POWDER FILLING METHOD AND COMPOSITE POWDER FILLING DEVICE, AND COMPOSITE POWDER MOLDING METHOD AND COMPOSITE POWDER MOLDING DEVICE

TECHNICAL FIELD

The present invention relates to a process for filling a multi-powder and an apparatus for filling a multi-powder as well as a process for compacting a multi-powder and an apparatus for compacting a multi-powder which make it possible to manufacture members whose constituent composition differs for every section with ease.

BACKGROUND ART

Even when mechanical component parts and the like are simple members, the required mechanical characteristics, functions and so forth often differ depending on sections. For example, when the shape is determined first in view of the installability and so on, there can be parts which can be of low strength and parts which can be of high strength. In this instance, if high-strength materials can be used for parts which can be of high strength and materials with good machinability and the like can be used for parts which can be of low strength, it is convenient because it is possible to expand the degree of freedom in designing, to reduce the weight, to improve the productivity, and so forth.

Moreover, when functions as structural materials are required on one of the opposite-end sides and functions such as a sliding property, wear resistance and heat resistance are required on the other one of the opposite-end sides, or when functions as magnetic materials are required on one of the opposite-end sides and functions as nonmagnetic materials are required on the other one of the opposite-end sides, if it is possible to produce multi-material segmented-part members comprising materials whose constituent compositions satisfy the respective requirements, it is preferable because it is possible to expand and the like the degree of freedom in designing and the functionality.

However, due to the convenience and the like in manufacturing, simple members so far have been basically formed of identical materials. In this case, the materials are determined by characteristics to which priority should be given, and the other required characteristics might often be sacrificed. If materials which satisfy both of the characteristics should have been used, such materials are expensive in general so that it is difficult to reduce the cost.

When different materials are cast around or deposited, or when partial heat treatments and the like are carried out, it is possible to provide simple members with different characteristics. However, the number of processes increases accordingly and the productivity degrades so that it is not possible to reduce the cost and so forth of the members.

It has been carried out to manufacture members by sintering compacts comprising powders whose constituent composition depends on sections. However, when powders whose constituent compositions differ are filled into a cavity at once, usually, a powder which exhibits high flowability is first filled thereinto, or a plurality of powders are disposed in a mixed manner. Hence, conventionally, the filling step has been carried out independently for each of powders whose constituent compositions differ, or preliminary compaction has been carried out every time one and only powder is filled thereinto and it has been carried out repeatedly, thereby manufacturing multi-material compacts.

Under such circumstances, it is needless to say that the man-hour requirements increase as described above and the productivity lowers so that it is difficult to reduce the cost of members.

DISCLOSURE OF INVENTION

The present invention has been done in view of such circumstances. Namely, it is an object to provide a process for filling a multi-powder and an apparatus for filling a multi-powder which can fill a plurality of powders into a cavity efficiently when manufacturing green compacts and the like in which required characteristics differ for every section.

Moreover, it is another object to provide a process for forming a multi-powder and an apparatus for compacting a multi-powder which can manufacture multi-powder compacts from the filled multi-powders efficiently.

Hence, the present inventors have been studying earnestly in order to solve this assignment, and have been repeated trials and errors, as a result, have thought of carrying out a filling process by introducing a gas through respective powder chambers in which a plurality of powders are held to make the flow resistance of the respective powders like-state, and have arrived at completing the present invention.

Process for Filling Multi-Powder

Namely, a process for filling a multi-powder according to the present invention comprises the steps of: moving a powder box, being disposed movably on a table and comprising a plurality of powder chambers storing a plurality of powders whose constituent compositions differ in a divided manner and having a bottom opening, onto a compacting die capable of forming a cavity into which the powders are filled; and filling a plurality of the powders into the cavity at once through the bottom openings by introducing a gas into the powder chambers to substantially equalize the respective flow resistances of a plurality of the powders, at least when the bottom openings are positioned above the cavity by the powder box moving step.

When the powder box is moved by the powder box moving step onto the compacting die and the bottom openings of the respective powder chambers superimpose on the cavity, a plurality of the powders drop into the cavity through the bottom openings to fill it.

In the present invention, a gas is introduced into the powder chambers in the filling step to substantially equalize the respective flow resistances of a plurality of the powders.

Accordingly, the flow resistance difference disappears between the respective powders substantially, the respective raw materials are hardly present in a mixed manner virtually, and they are being filled into the cavity. And, in the cavity, the respective powders form a desired boundary so that they are put into an orderly-filled state substantially.

As a result, it is possible to reduce the overall man-hour requirements because the filling of a plurality of the powders into the cavity (multi-powder filling) is carried out in a single step securely. And, it results in improving the productivity and reducing the cost when manufacturing multi-powder compacts.

Here, the introducing amount of the gas can be changed and adjusted appropriately depending on using powders. When the introducing amount is adjusted, it is possible to adjust the flow resistance of powders.

The above-described "to substantially equalize the respective flow resistances of a plurality of the powders" means that the respective powders are not disposed in a mixed manner virtually, and it is not needed to strictly equalize the respective flow resistances.

Moreover, the above-described "filling a plurality of the powders into the cavity at once through the bottom openings" can be satisfactory when at least two or more powders are filled substantially simultaneously, and does not preclude to carry out the present process for filling a multi-powder repeatedly.

In addition, the "multi-powder" means a plurality of powders, and is used in the present specification regardless of before or after powders are filled.

Incidentally, in the present filling process, since the raw materials are filled by introducing the gas into the powder chambers, the air substitutes for the powders more easily in the cavity than the case where no gas is introduced. Accordingly, it is possible to shorten the filling time. Moreover, fine powders and the like are inhibited from soaring and so forth so that it is possible to carry out uniform and high-density filling in which the segregation and so on of the components and particle sizes hardly occur.

Moreover, when a compacting step is carried out after the filling, it is possible to net-shape products, and in addition it is possible to inhibit the weight from fluctuating so that it is possible to obtain products with high accuracy. Therefore, it is possible as well to reduce the man-hour requirements for the subsequent working.

Note that to fill powders by introducing a gas per se had been applied already by the present applicants. For example, the details are disclosed in Japanese Patent No. 2,952,190, Japanese Unexamined Patent Publication (KOKAI) No. 11-104,894, and the like.

Apparatus for Filling Multi-Powder

Not limited to the above-described process for filling a multi-powder, the present invention can be adapted for an apparatus which can realize the process.

Namely, the present invention can be adapted for an apparatus for filling a multi-powder, comprising: a powder box being disposed movably on a table, and comprising a plurality of powder chambers storing a plurality of powders whose constituent compositions differ in a divided manner and having a bottom opening; a gas feed pipe for feeding a gas to be introduced into the powder chambers; and an actuator for moving the powder box onto a compacting die capable of forming a cavity into which the powders are filled; wherein it can fill a plurality of the powders into the cavity at once through the bottom openings by introducing a gas through an introducing hole of the gas feed pipe to substantially equalize the respective flow resistances of a plurality of the powders, at least when the bottom openings are positioned above the cavity.

In this case as well, the aforementioned descriptions on the process for filling a multi-powder are applicable.

Process for Compacting Multi-powder

Moreover, not limited to filling powders, the present invention can be adapted for carrying out a compacting step subsequently.

Namely, the present invention can be adapted for a process for compacting a multi-powder, comprising the steps of: moving a powder box, being disposed movably on a table and comprising a plurality of powder chambers storing a plurality of powders whose constituent compositions differ in a divided manner and having a bottom opening, onto a compacting die capable of forming a cavity into which the powders are filled; filling a plurality of the powders into the cavity at once through the bottom openings by introducing a gas into the powder chambers to substantially equalize the respective flow resistances of a plurality of the powders, at least when the bottom openings are positioned above the cavity by the powder box moving step; and producing a multi-powder compact by pressurizing a multi-powder comprising a plurality of the powders after the filling step.

In this case as well, the aforementioned descriptions on the process for filling a multi-powder are applicable.

Apparatus for Compacting Multi-powder

In addition, not limited to the above-described process for compacting a multi-powder, the present invention can be adapted for an apparatus which can realize the process.

Namely, the present invention can be adapted for an apparatus for compacting a multi-powder, comprising: a powder box being disposed movably on a table, and comprising a plurality of powder chambers storing a plurality of powders whose constituent compositions differ in a divided manner and having a bottom opening; a gas feed pipe for feeding a gas to be introduced into the powder chambers; a compacting die capable of forming a cavity into which the powders are filled; an actuator for moving the powder box onto the compacting die; and compacting means for pressurizing a multi-powder, comprising a plurality of the powders which are filled into the cavity at once through the bottom openings by introducing a gas through an introducing hole of the gas feed pipe to substantially equalize the respective flow resistances of a plurality of the powders, at least when the bottom openings are positioned above the cavity, to make a multi-powder compact.

In this case as well, the aforementioned descriptions on the process for filling a multi-powder are applicable.

BEST MODE FOR CARRYING OUT THE INVENTION

A. Mode for Carrying Out

Figure 1A:
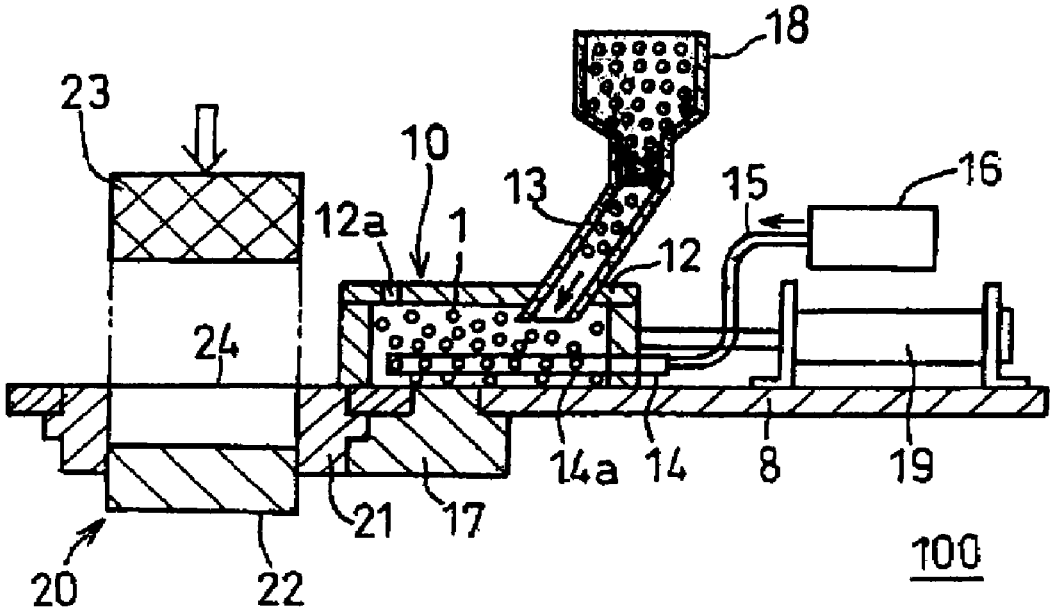
FIG. 1A is a cross-sectional view for illustrating an apparatus for compacting a multi-powder according to Example No. 1 of the present invention, and shows when a powder box is not above a compacting die.

Subsequently, the present invention will be described more specifically while naming embodiment modes. Note that the details described hereinafter are applicable to the process for filling a multi-powder, the apparatus for filling a multi-powder, the process for compacting a multi-powder and the apparatus for compacting a multi-powder appropriately.

(1) Raw Material Powders

The powders can be metallic powders such as iron-based powders, aluminum-based powders, titanium-based powders and copper-based powders in which Fe, Al, Ti and Cu are the major component, and additionally can be ceramic powders, graphite powders and lubricant powders, and can further be mixture powders of them. Note that the "powders whose constituent compositions differ" referred to in the present invention are not limited to powders of the same system (for example, iron-based powders whose alloying components differ), but can be powders of different system (for instance, metallic powders and ceramic powders).

The particle diameter of the powders is not limited, but can be particle diameters which do not cause to clog and the like the introducing hole of the gas feed pipe. Moreover, in view of the handleability, fillability, formability, sinterability and so forth, it is advisable to select the particle diameter of the powders.

(2) Aeration Value

The inherent flow resistance of the powders depends on the type of the powders. Therefore, it is necessary to appropriately adjust the flow of the gas to be introduced into the powder chambers depending on the type and the like of the powders. As an index correlating with the flow resistance, the present inventors confirmed that it is possible to use the aeration value. The aeration value is a ratio Vg/Vp (1/s) of a gas flow Vg (mL/s) to be introduced into a powder chamber with respect to a volume Vp (mL) of a powder in the powder chamber.

When the aeration value is too small, it is difficult to adjust the fluidity between the powders, and the respective powders cannot be filled into the cavity without disposing them in a mixed manner. When the aeration value is too large, bubbling occurs from the top surface of the powders in the powder chambers to soar fine powders and the like, and it is not possible to carry out filling the powders uniformly. Therefore, it is advisable to set the aeration value within a range in which no such circumstances occur. Appropriate aeration values can be related not only to the composition of the powders but also to the particle diameter.

For example, when the powders are ferrous powders in which iron is a major component and whose average particle diameter is 250 μm or less, further preferably from 50 to 200 μm, it is suitable to set the aeration value Vg/Vp from 0.05 to 0.4 (1/s).

Anyway, it is necessary to adjust the aeration value depending on the type of the powders. Hence, it is better that the gas flow which is supplied from a gas supply source to the gas feed pipe can be adjusted, for instance. Namely, it is suitable to dispose flow regulating means capable of regulating a gas flow introduced through the introducing hole independently for each of the powder chambers.

The flow regulating means is manual or automatic flow regulating valves, for example. When it is automatic, it is advisable to dispose flow resistance measuring means in the powder chambers so that the introducing amount through the introducing hole can be regulated automatically depending on the outputs. The flow resistance measuring means is disclosed in Japanese Unexamined Patent Publication (KOKAI) No. 11-104,893 which the present applicants had applied already.

Note the gas to be introduced into the powder chambers can preferably be gases, such as dry air and inert gases ($N_2$, He, Ar and the like), which do not oxidize the powders. Moreover, it is advisable to appropriately spout a heated gas to heat or warm the powders at a desired temperature.

The gas is required to be being introduced when the powders are filled into the cavity from the powder chambers. Hence, when the introducing timing is set only at their filling into the cavity, it is possible to save the using gas flow. Meanwhile, when it is introduced always, it is easy to control the introducing of the gas.

(3) Powder Box

The powder box comprises a plurality of powder chambers storing a plurality of powders whose constituent compositions differ in a divided manner, and having a bottom opening.

The shape, size and the like of the powder chambers and powder box are determined by taking the shape, size and so forth of the compacting die and cavity into consideration. Therefore, the powder box is not limited to squared shapes, either, however, when the powder box is formed as squared shapes, it is possible to form a plurality of powder chambers with ease by disposing partitions at proper intervals. Naturally, a plurality of powder boxes storing a single type of powders can be collected to make the "powder box" referred to in the present invention.

The opening formed in the bottom of the powder chambers is determined as well by taking the shape of the powder box and powder chambers and further the shape of the cavity into consideration. Indeed, it is advisable to fully open the bottom surface of the squared powder box or powder chambers simply. Since the powder box is disposed on a table, no powders fall. When the powder box moves on a table and the bottom openings come above the cavity, the powders are filled into the cavity. Moreover, when the powder box moves, the so-called leveling of the powders is carried out.

When the powder box is formed as squared shapes, it is preferred that a powder-chamber partition (partition plate) can be disposed parallel to the moving direction. Thus, the respective powders are more likely to be filled into the cavity substantially simultaneously. And, when the respective powders are filled into the cavity substantially simultaneously, the respective powders are more likely to be suppressed or inhibited from existing in a mixed manner.

Note that the replenishing of the powders into the respective powder chambers can be carried out by a hopper and the like continuously. Accordingly, it is possible to fill the powders into the cavity continuously.

(4) Gas Feed Pipe

The gas feed pipe feeds the gas into the powder chambers. The form (shape, quantity and the like) and disposing position can be selected appropriately depending on the type of the powders, the powder chamber shape, the cavity shape and so forth.

For example, the outer cross-sectional shape of the gas feed pipe can be circular shapes, ellipse shapes, slot shapes, streamline shapes, and the like. When it is formed as streamline shapes, the powders can fall into the cavity smoothly. Moreover, when it is formed as circular shapes, it is possible to produce less expensively because commercially available pipes can be utilized therefor. It is possible to appropriately select the diameter, disposing quantity, disposing intervals, disposing order (parallelly or alternately), and so forth. For instance, when round pipes are used, the outside diameter "D" of the gas feed pipe can be 1 mm≦"D"≦3 mm. And, representative gas feed pipes can be the pipes provided with introducing holes on the outer-peripheral side of these pipes.

Moreover, the disposing position of the gas feed pipe can be at one's will, however, when the gas feed pipe is disposed on the bottom side of the powder chambers, for example, it is preferable because it is possible to control the flow resistance of the powders in the powder chambers efficiently and easily. When the gas feed pipe is disposed on the bottom side of the powder chambers, it is advisable to set the disposing height "h" with respect to the height "H" of the powder chambers so as to be 0.01≦"h"/"H"≦0.3, for instance.

The disposing direction of the gas feed pipe can be either parallel or vertical to the moving direction of the powder box.

The material of the gas feed pipe can preferably be metals, resins and the like which can be worked with ease. Especially, in view of inhibiting rusts, securing strength and so forth, it is preferable to use stainless steels.

It is advisable similarly to determine the shape and quantity of the introducing hole by taking the size and shape of the powder chambers, the required aeration value and the like into consideration. For example, the introducing hole can be directed in the up and down directions of the gas feed pipe, can be directed in the right and left directions, or can be directed in the oblique direction (for instance, in a direction inclined by from 30° to 60° approximately from the top).

The interval "w" between the introducing holes can be at intervals of from 3 to 10 mm, for example, moreover, can be set with respect to the powder chamber width "W" so as to be 0.02≦"w"/"W"≦0.3.

The diameter of the introducing holes can be set so that the introducing hole diameter "d" is 10 μm≦"d"≦200 μm, for example. It is advisable to appropriately combine the introducing holes having different diameters, to change the introducing hole diameter or disposing quantity depending on the disposing positions of the gas feed pipe. Such introducing holes can be processed by machining (drilling) or laser processing and the like, for instance. However, when materials (for example, meshed materials and so forth) exhibiting permeability are used, boring can be obviated.

(5) Compacting Die

The compacting die forms the cavity into which the powders are filled. Moreover, the compacting die can constitute compacting means.

The compacting die comprises a die, a lower punch and an upper punch, for example, the cavity is formed by the die and the lower punch, and the compacting means comprises the upper punch for pressing a multi-powder in the cavity.

Naturally, the shapes and dividing manners of the punch and die can be selected appropriately depending on the shapes of desired compacts.

Note that the manner of filling the powders into the cavity can be either so-called filling by gravity or filling by suctioning. Moreover, it can be filling by pushing upward. The filling by pushing upward is a method of filling in which is the lower punch is made dividable; both of the punches are descended temporarily to form a provisional cavity; a powder is filled thereinto; and thereafter one of the divided punches is pushed upward while keeping the powder being filled, thereby turning the cavity shape into desired shapes.

(6) Multi-material Component

When the present invention is used, it is possible to efficiently produce components which have different characteristics for every section. The components can be used as compacted products per se, or the compacts are sintered to use them as sintered products. Moreover, they can be subjected to sinter forging to use them as sinter-forged products.

For example, in functional component parts, powders (magnetic powders and non-magnetic powders) whose magnetic characteristics differ are compacted to make magnetic cores (compacted products). In mechanical component parts, compacts of multi-powders are sintered to secure strength. Moreover, like connecting rods and so forth, when they are required to exhibit higher strength, fatigue resistance and so on, they are made into sinter forged products.

Not limited to these, the present invention can be utilized for producing all members comprising multi-powders.

B. EXAMPLES

Subsequently, while giving examples, the present invention will be described in more detail.

Example No. 1

(1) Apparatus for Forming Multi-powder

Figure 2A:
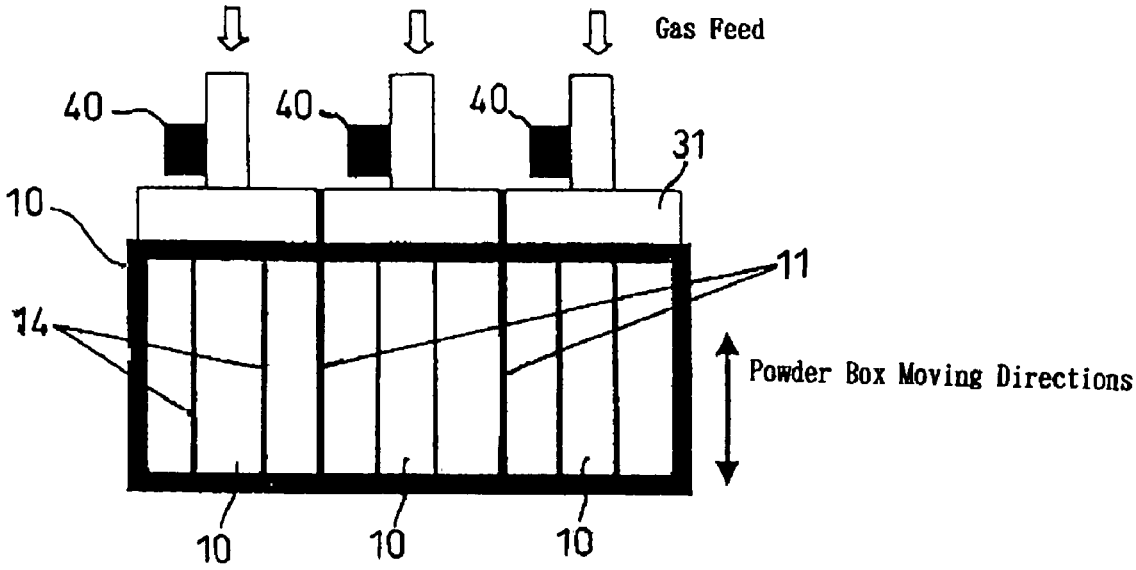
FIG. 2A is an enlarged planar cross-sectional view of the powder box.
Figure 2B:
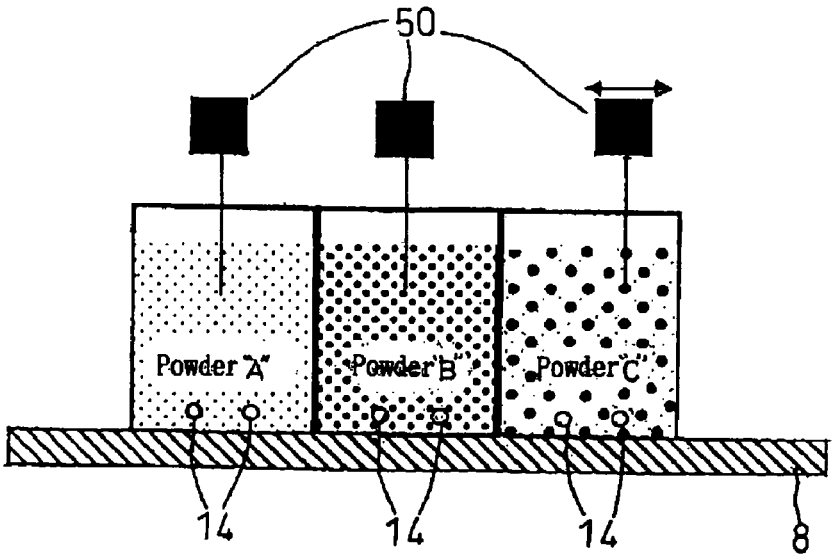
FIG. 2B is an enlarged lateral cross-sectional view of the powder box.
Figure 3:
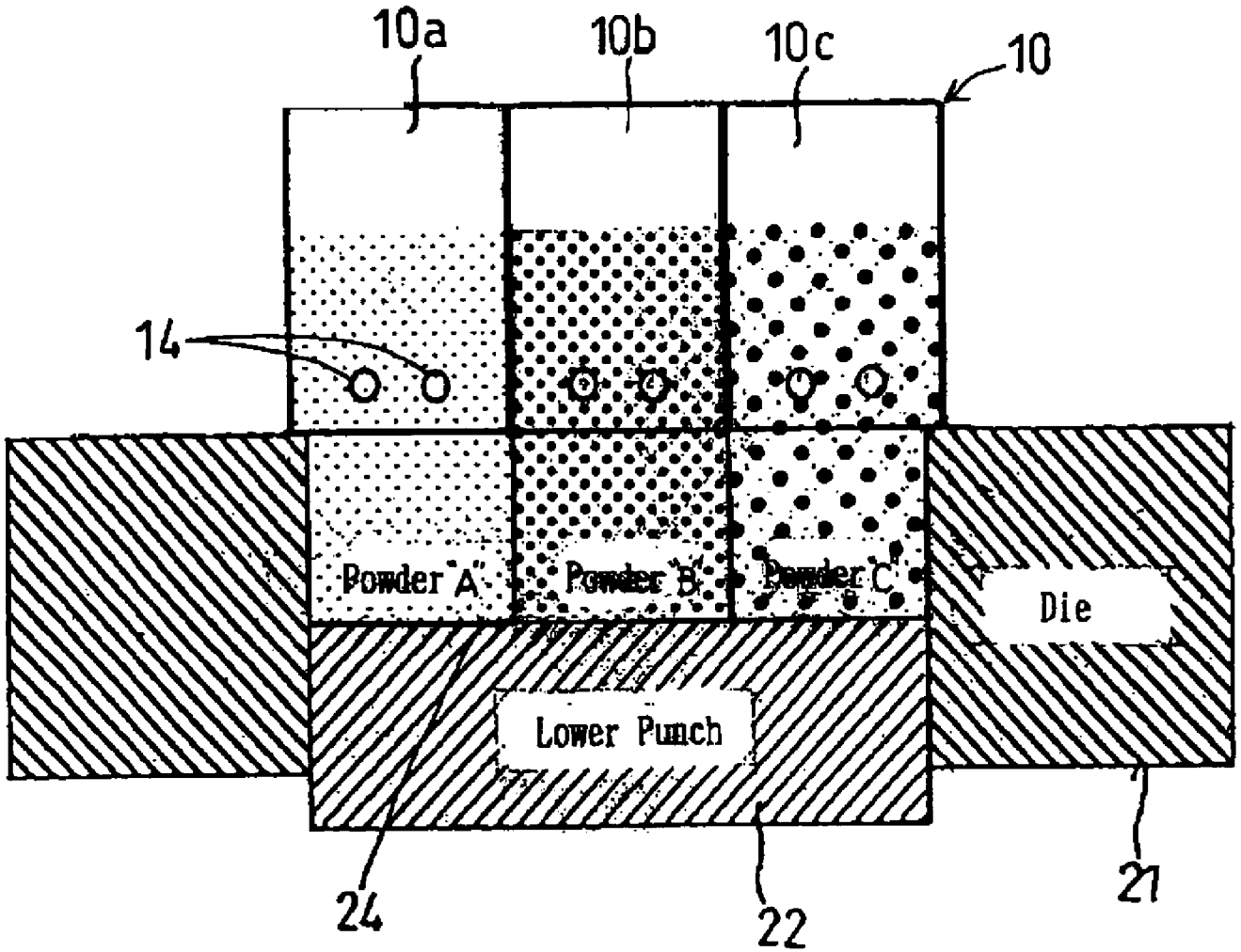
FIG. 3 is a diagram for illustrating how powders are filled into a cavity from the powder box in the example.

FIGS. 1 through 3 illustrate a multi-powder compacting apparatus 100, Example No. 1 according to the present invention.

Figure 1B:
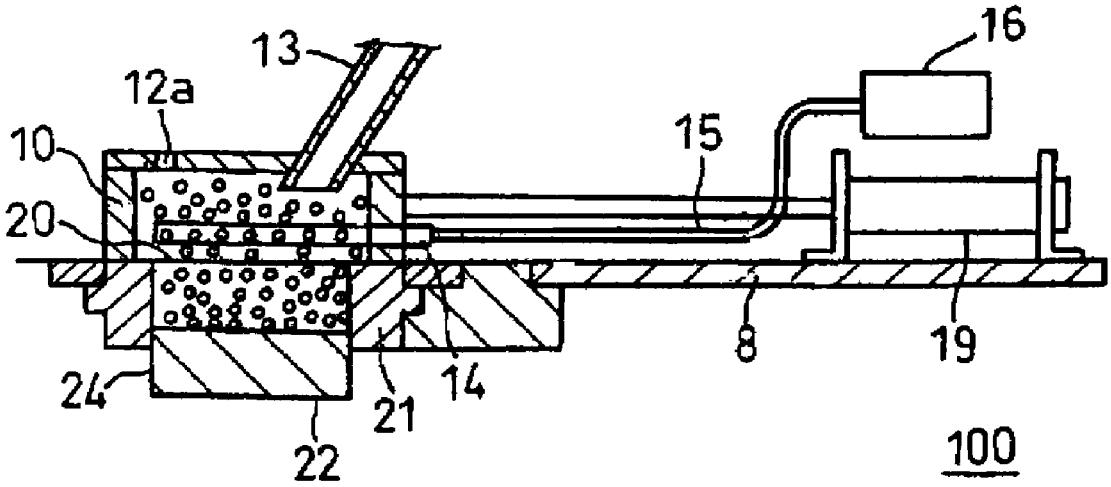
FIG. 1B shows the powder box is above the compacting die.

FIG. 1 is an overall cross-sectional view of the multi-powder compacting apparatus 100; FIG. 1A illustrates the multi-powder compacting apparatus 100 before a step of moving a powder box; and FIG. 1B shows the multi-powder compacting apparatus 100 in a filling step. FIG. 2 illustrates a cross-sectional view of a later-described powder box 10; FIG. 2A shows a planar cross-sectional view of the powder box 10; and FIG. 2B illustrates a lateral cross-sectional view.

As can be seen from the filling step shown in FIG. 3, the multi-powder compacting apparatus 100 can fill three powders "A," "B" and "C," whose constituent compositions differ, into a cavity 24 substantially free of disposing them in a mixed manner. Hereinafter, the respective arrangements of the multi-powder compacting apparatus 100 will be described in detail.

The multi-powder compacting apparatus 100 comprises a table 8, a powder box 10 disposed on the table 8, a hopper 18 for supplying a powder 1 to the powder box 10, a pipe 14 disposed in the powder box 10, a gas supply source 16 for supplying a gas to the pipe 14, an actuator 19 for reciprocating the powder box 18 on the table 8, and a compacting die 20 disposed continuously from the table 8.

The powder box 10 comprises a housing which is formed as a laterally-long square-shaped frame with respect to the moving directions. As can be seen from FIG. 2A, the powder box 10 is divided into three powder chambers 10*a*, 10*b* and 10*c* by two partition plates 11 which are fixed to the inside. And, the powders "A," "B" and "C" are stored in the powder chambers 10*a*, 10*b* and 10*c* so as not to exist in a mixed manner. In the present example, the partition plates 11 are disposed parallel to the moving directions of the powder box 10.

The upper side of the powder box 10 is covered with a cover 12, and is communicated with the outside through an exhaust hole 12*a* which is disposed in the cover 12. The lower side of the powder box 10, namely, the bottom of the powder chambers 10*a*, 10*b* and 10*c* is opened, and accordingly forms the bottom opening set forth in the present invention. Indeed, as can be seen from FIG. 2B, the front view, the powders "A," "B" and "C" stored in the powder box 10 contact with the top surface of the table 8, and are held by the top surface.

The powder 1 comprises the powders "A," "B" and "C" whose constituent compositions differ as described above. The powder "A" is a commercially available alloy powder (produced by Höganäs AB.) whose particle diameter is 250 μm or less, which comprises Fe-4Ni-2Cu1.5Mo-0.6C+0.8ZnSt, and which is subjected to a segregation prevention treatment; the powder "B" is a commercially available alloy powder (produced by Höganäs AB.) whose particle diameter is 250 μm or less, which comprises Fe-2Cu-0.9C+0.8Lub, and which is subjected to a segregation prevention treatment; and powder "C" is a powder in which a commercially available partial-diffusion alloy powder (produced by Höganäs AB.), whose particle diameter is 250 μm or less and which comprises Fe-10Cu, is mixed with 0.8% ZnSt. Moreover, the proportion of the respective elements is expressed in percentage by mass (being the same hereinafter).

The hopper 18 supplies the powders "A," "B" and "C" being the powder 1 into the powder chambers 10*a*, 10*b* and 10*c* through the supply hose 13, respectively. Although the details are not illustrated, the hopper 18 and the supply hose 13 are demarcated so that the respective powders "A," "B" and "C" do not exist in a mixed manner.

The pipe 14 corresponds to the gas feed pipe set forth in the present invention, and is disposed in the vicinity of the bottom of the powder chambers 10*a*, 10*b* and 10*c* in the powder box 10, respectively. One of the opposite ends is fixed to the frame of the powder box 10 to close. The other one of the opposite ends is fixed to a supporting plate 31 which has a gas passage therein. The gas passage is formed for each of the powder chambers 10*a*, 10*b* and 10*c*, and the respective gas passages connect with the pipe 14 of the respective powder chambers. The pipe 14 is an outside diameter ϕ1.26 mm× inside diameter ϕ0.9 mm pipe made of stainless steel, and is disposed in a quantity of four for each of the powder chambers 10*a*, 10*b* and 10*c*. Moreover, in the respective pipe 14, micro introducing holes 14*a* whose hole diameter is ϕ50 μm are formed at intervals of 5 mm in three directions. In the case of the present example, the inside shape of the respective powder chambers 10*a*, 10*b* and 10*c* is identical, and has 20 in width×20 in length×60 mm in height. The pipes 14 are disposed at a position of 6 mm off the bottom surface (the top surface of the table 8) parallel to the moving directions of the powder box 10.

The gas supply source 16 is a 0.4 MPa compressed air source. Specifically, it is air piping which is laid in plants. Naturally, independent air compressors can be adapted for the gas supply source 14, or nitrogen gas cylinders and the like can be adapted for the gas supply source 16 in addition to air.

When compressed air is supplied to the respective gas passages in the supporting plate 31 from the gas supply source 16 by way of a flexible hose 15, the air is introduced through the introducing holes 14*a* of the pipe 14. In this instance, the introducing amount can be regulated by flow regulating valves 40 which are disposed on an upstream side of the supporting plate 31.

Moreover, the multi-powder forming apparatus 100 is provided with flow-resistance measuring devices 50 which can measure the flow resistance in the respective powder chambers 10*a*, 10*b* and 10*c* independently, as illustrated in FIG. 2B. The flow-resistance measuring devices 50 comprise a load cell which is provided with a probe with a strain gage. When the load cells are vibrated while the respective probes are fitted into the powders "A," "B" and "C" by 10 mm approximately, the probes are deformed depending on flow resistances. The strains are converted into electric signals by the strain gages. The electric signals are taken in by a later-described control apparatus, and accordingly the flow resistances in the respective powders "A," "B" and "C" are detected. In accordance with the thus detected flow resistances, the control apparatus controls the flow regulating valves 40 so as to substantially equalize the flow resistances in the powder chambers 10*a*, 10*b* and 10*c*. Since the flow resistances can fluctuate when operating the multi-powder compacting apparatus 100, it is preferable to carry out controlling the flow resistances continuously or at predetermined intervals by the control apparatus. Note that the flow-resistance measuring devices correspond to the flow-resistance measuring means, and the control apparatus and the flow regulating valves 40 constitute the flow regulating means.

The compacting die 20 comprises a squared-annular die 21, a lower punch 22 fitted into the inner side and being ascendable from below and descendable, and an upper punch 23 fitted into the inner side and being ascendable and descendable from above, as illustrated in FIG. 1 and FIG. 3. The die 21 is fixed to the table 8 by a die holder 17. The top surface and the top surface of the table 8 form a continuous plane. When the lower punch 22 descends in the die 21, a parallelepiped-shaped cavity 24 is formed.

The actuator 19 is an air cylinder reciprocating between stoppers which are disposed at a retract-end position (FIG. 1A) and an advance-end position (FIG. 1B). The actuator 19 can be hydraulic cylinders or driving motors, however, it is possible to utilize air piping in plants when it is air cylinders.

When the powder box 10 is driven by the actuator 19 and each of the bottom opening of the powder chambers 10*a*, 10*b* and 10*c* comes above the cavity 24, the powders "A," "B" and "C" whose constituent compositions differ are filled into the cavity 24 without being disposed in a mixed manner as illustrated in FIG. 3.

After the powders "A," "B" and "C" are filled, the powder box 10 returns, and the upper punch 23 descends from above the compacting die 20 to pressurize the resulting multi-powder. The pressurizing with the upper punch 23 is carried out by a not-shown hydraulic pressing machine. The upper punch 23 and hydraulic pressing machine make the compacting means.

Note that the control apparatus comprising a not-shown computer performs to control the ascending and descending of the lower punch 22 and upper punch 23, the flow regulating valve 40, the actuator 19, and the like.

(2) Aeration Value

Figure 4:
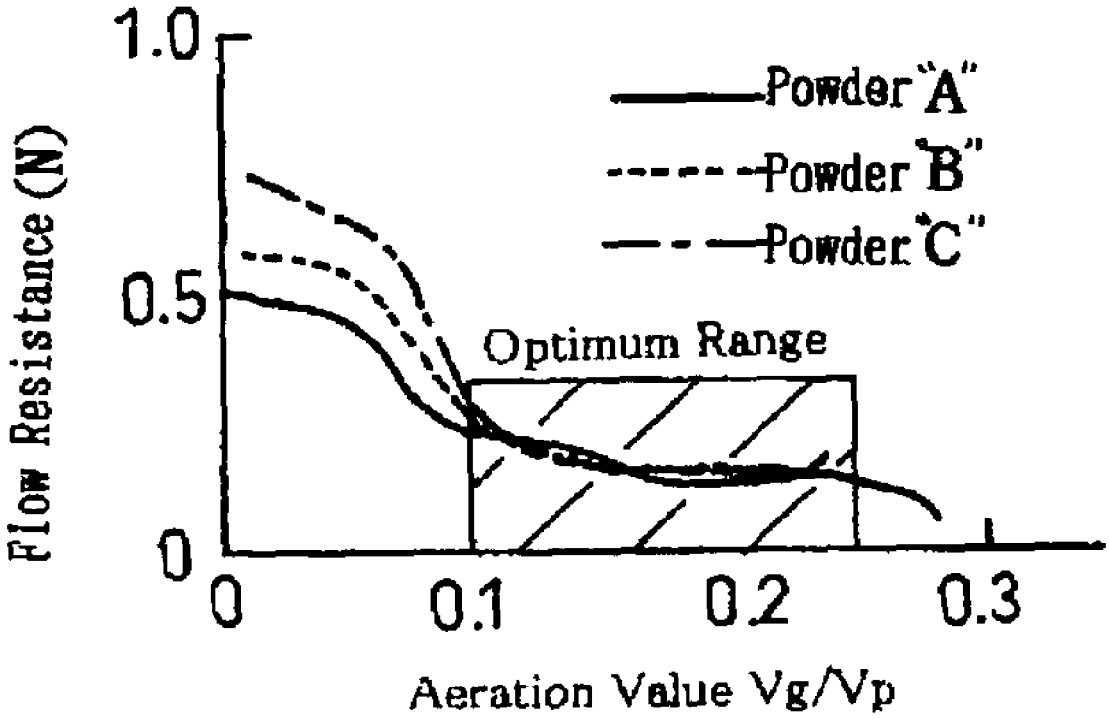
FIG. 4 is a graph for illustrating the relationships between the aeration values and flow resistances of three powders used in the example.

The correlation between the aeration values and flow resistances which related to the above-described powders "A," "B" and "C" was examined by using the multi-powder compacting apparatus 100. FIG. 4 illustrates the results.

From FIG. 4, regardless of the type of powders, it was confirmed that the respective flow resistances become identical substantially when the aeration value was from 0.1 to 0.3 (1/s). Therefore, when the aeration values are set within the range and the filling of powders is carried out, the powders "A," "B" and "C" are filled without disposing them in a mixed manner as illustrated in FIG. 3.

(3) Multi-powder Compact

The multi-powder compacting apparatus 100 was used, the aeration values were set in common to 0.15 (1/s), and the above-described powders "A," "B" and "C" were filled into the cavity 24 (a filling step).

Figure 5A:
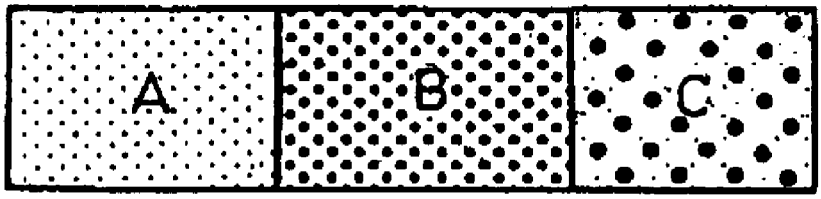
FIG. 5A is a schematic cross-sectional diagram of a multi-powder compact, and shows when it was filled by introducing a gas into powder chambers.
Figure 5B:
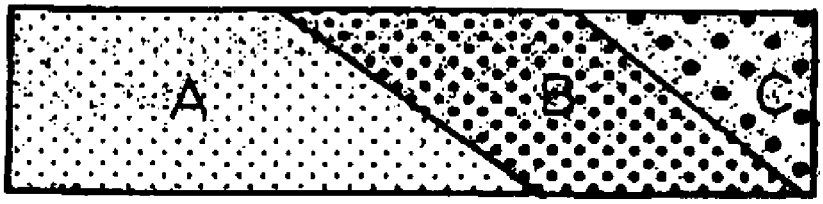
FIG. 5B shows when it was filled without introducing a gas into the powder chambers.

The thus filled multi-powder was pressurized at 588 MPa by using the upper punch 23, thereby manufacturing a multi-powder compact (a compacting step). FIG. 5A shows it. Note that FIG. 5B shows one which was made by filling the powders "A," "B" and "C" at once without introducing the air through the pipe 14 (specifically, by setting the aeration values to 0) and by forming under the same conditions.

When the flow resistances in the powders "A," "B" and "C" were equalized substantially by setting the aeration values appropriately, a multi-powder compact was produced which had an explicit boundary for the respective compositions. On the other hand, when the aeration values were set to 0, a compact was produced in which powders exhibiting a small flow resistance (specifically, powders exhibiting high fluidity) were diffused downward as illustrated in FIG. 5B. Therefore, it is understood that it is very difficult to let only desired regions have desired compositions when air is not introduced in filling powders.

Example No. 2

(1) Production of Transverse Test Piece

Figure 6A:
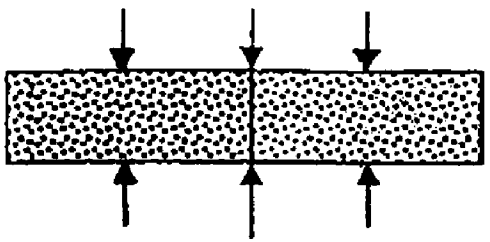
FIG. 6A is a diagram for illustrating the shape of a transverse test piece according to Example No. 2 of the present invention, and the measurement positions.

A similar apparatus was used in which the shape and the like of the powder box 10 and compacting die 20 of the multi-powder compacting apparatus 100 were varied, and transverse test pieces illustrated in FIG. 6A were manufactured whose size was 55 in length×10 in width×5 mm in thickness. In the present example, an Fe-2Cu-0.6C powder (hereinafter referred to as "powder A'") and an Fe-2Cu-0.8C powder (hereinafter referred to as "powder "B'") were packed in the respect powder chambers which were demarcated by a partition plate at the middle of the powder box, the respective powders were filled into a cavity, and thereafter the transverse test pieces were manufactured via the respective steps of forming and sintering.

The powder "A'" and powder "B'" were mixture powders in which an Fe powder, an Fe-10Cu powder and a graphite powder were mixed so that the overall compositions were Fe-2Cu-0.6C and Fe-2Cu-0.8C, respectively. The Fe powder and Fe-10Cu powder which were used herein were commercially available powders whose particle diameter was 250 μm or less and which were produced by Höganäs AB., respectively. The graphite power was a commercially available powder whose particle diameter was 10 μm or less and which was produced by Nihon Kokuen Co., Ltd.

The filling step was carried out by suction filling, and bottled nitrogen was injected with an aeration value of 0.15 (1/s).

The forming step was carried out by setting the compacting pressure to 588 MPa. In the compacting, zinc stearate (ZnSt) being a lubricant was added to the respective powders in an amount of 0.8% by mass.

The sintering step was carried out in a nitrogen atmosphere at 1,150° C. for 30 minutes. Thereafter, they were cooled at a rate of 100° C./min.

The density of the transverse test pieces comprising the thus produced sintered bodies was $7.05\times10^3$ kg/m$^3$ (7.05 g/cm$^3$)

(2) Assessment on Transverse Test Piece

Figure 6B:
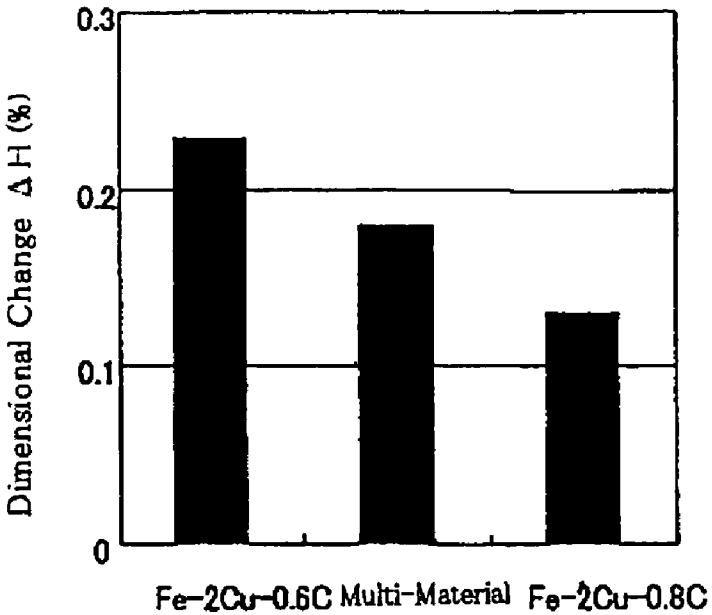
FIG. 6B is a bar graph for illustrating the dimensional change proportions at the respective measurement positions in the transverse test piece.

① The width-wise dimensional changes of the transverse test pieces before and after the sintering were examined at 3 locations illustrated in FIG. 6A. FIG. 6B illustrates the results.

The dimensional change of the boundary portion (between the powders "A" and "B") at which the powders having different compositions contacted was an intermediate value between the dimensional change of the Fe-2Cu-0.6C material portion and the dimensional change of the Fe-2Cu-0.8C material portion.

Figure 7:
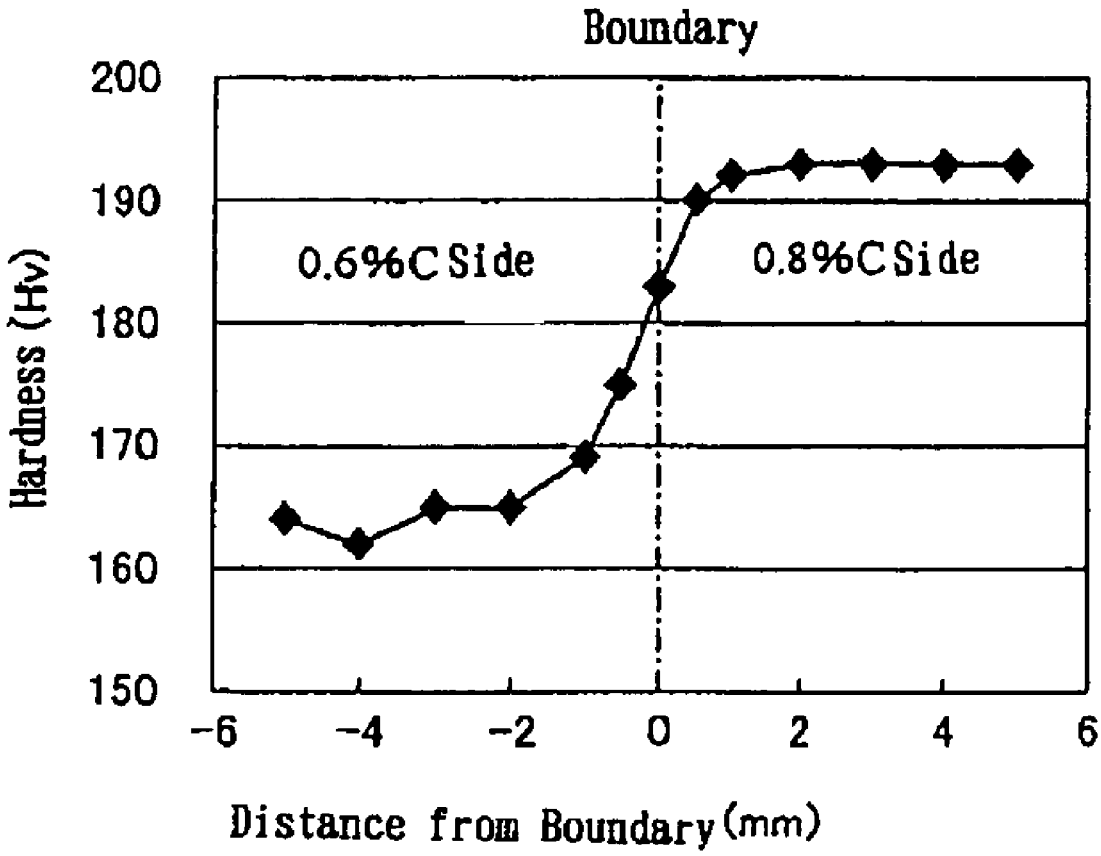
FIG. 7 is a graph for illustrating the variation of the hardness in the vicinity of the boundary in the transverse test piece.

② The hardness distribution was measured in the vicinity of the boundary portion. FIG. 7 illustrates the results. It is understood that the hardness varied remarkably within a range of 1 mm-opposite sides in which the boundary between the Fe-2Cu-0.6C layer and the Fe-2Cu-0.8C layer is placed.

This resulted from the fact that the Fe-2Cu-0.6C layer and the Fe-2Cu-0.8C layer differed in terms of the carbon content only, and that carbon was diffused from the high-concentration side to the low-concentration side by sintering, and that hardness distributions appeared depending on the concentration distribution of the carbon content.

Figure 8B:
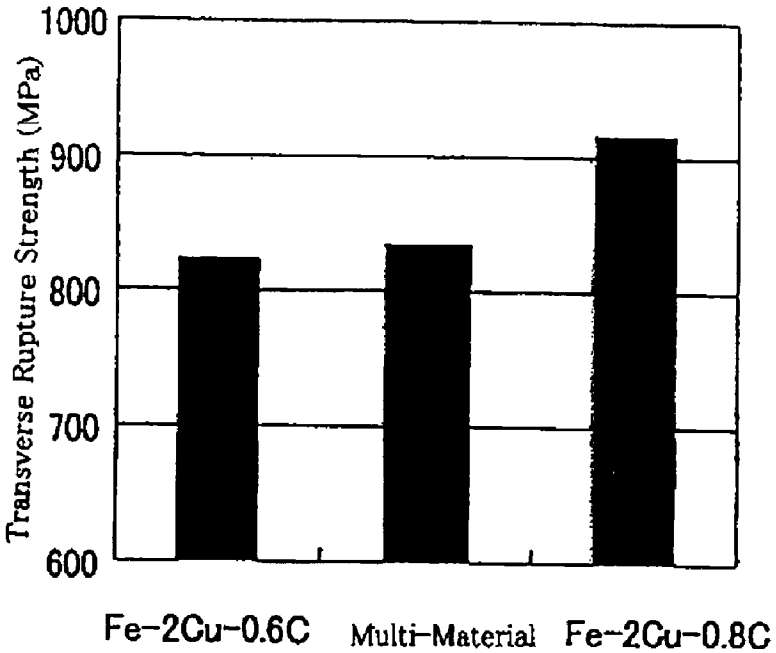
FIG. 8B is a bar graph for comparing the strength of the boundary portion with the strength of the other portions.
Figure 8A:
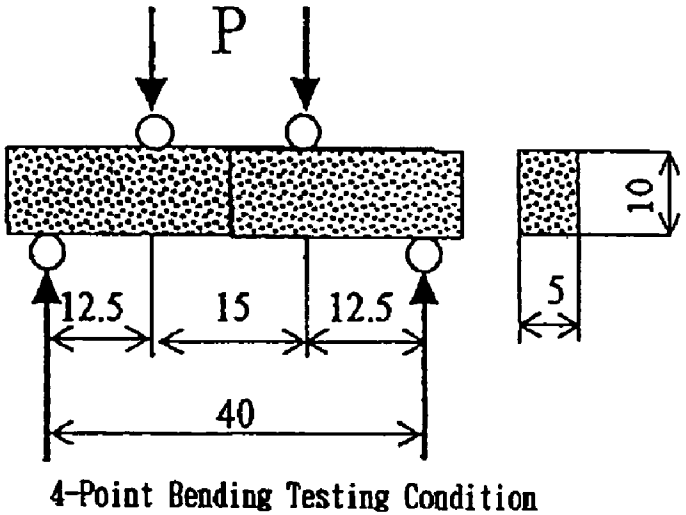
FIG. 8A is a diagram for explaining a 4-point bending transverse test, a transverse test for it.

③ The transverse test pieces were subjected to a 4-point bending transverse test illustrated in FIG. 8A. The 4-point bending transverse test was designed so that a uniform stress could be applied between fulcrums with the above-described boundary portion interposed therebetween. FIG. 8B illustrates not only the transverse rupture strength at the boundary portion but also the transverse rupture strength at the Fe-2Cu-0.6C single material and the transverse rupture strength at the Fe-2Cu-0.8C single material.

It is understood that the boundary portion secured a strength equivalent to that of the Fe-2Cu-0.6C single material at least. On the contrary, since the strength of the boundary portion was substantially identical with the strength of the Fe-2Cu-0.6C, it is believed that an explicit boundary was formed.

Example No. 3

(1) Production of Connecting Rod

Figure 9A:
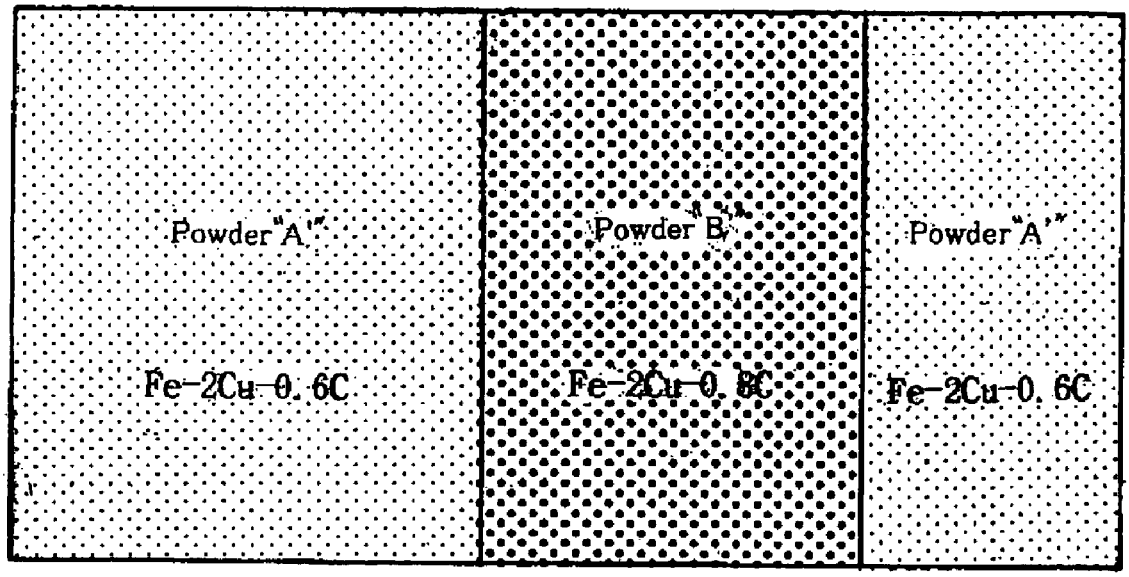
FIG. 9A is a schematic diagram of a disposition in powder chambers in which powders used in Example No. 3 of the present invention are held.
Figure 9B:
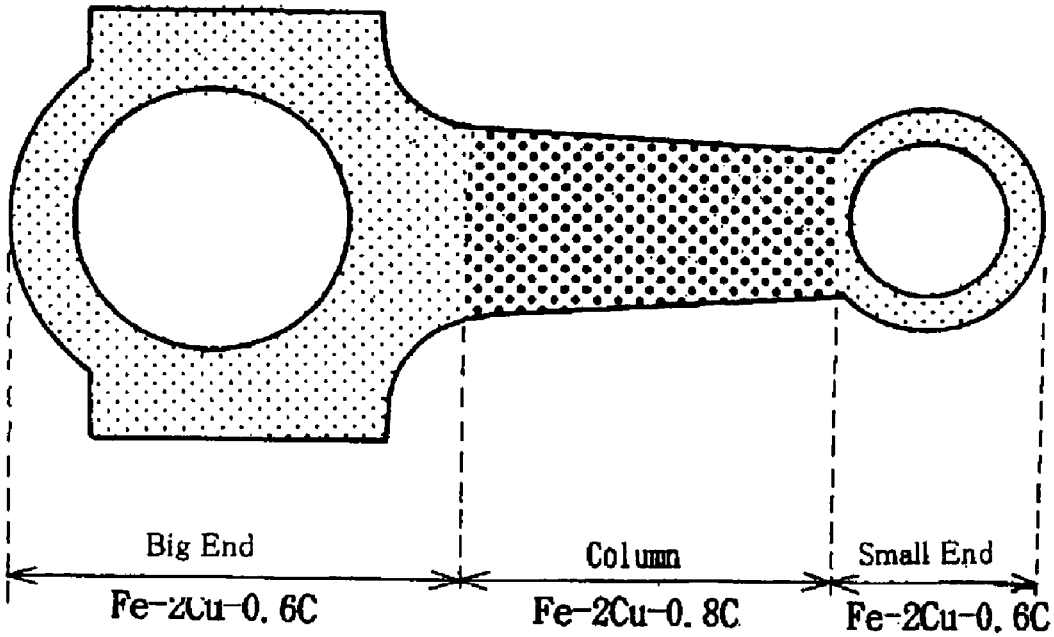
FIG. 9B is a schematic diagram for illustrating a compact, a connecting rod comprising the powders (a multi-powder).

① A similar apparatus was used in which the shape and the like of the powder box 10 and compacting die 20 of the multi-powder forming apparatus 100 were varied, and sinter forged connecting rods were manufactured whose size was ϕ 55 mm in big-end diameter×ϕ 22 mm in small-end diameter×160 mm in center distance. Specifically, as illustrated in FIG. 9A, the above-described powder "A'" and powder "B'" were packed in the respective powder chambers alternately, these were filled into a cavity, and thereafter sinter forged connecting rods illustrated in FIG. 9B were manufactured via the respective steps such as compacting, sintering and forging.

In the case of the present example, the inner shape of the respective chambers were 120 in width×200 in length×60 mm in height, 80 in width×200 in length×60 mm in height and 60 in width×200 in length×60 mm in height in this order from the major-end side. In the respective powder chambers, the pipe being the gas feed pipe was disposed in a quantity of 11 pieces, 7 pieces and 5 pieces in the order from the major-end side. The shape, disposition height and the like of the pipe and introducing hole were the same as those of Example No. 1.

The filling step was carried out by gravity filling. During the filling, air piping of a plant was used as a supply source, air was flown with an aeration value of 0.15 (1/s) into the respective powder chambers through the respective pipes.

The forming step was carried out in the same manner as Example No. 2. Specifically, the compacting pressure was set at 588 MPa, and zinc stearate was added to the respective powders in an amount of 0.8% by mass.

The sintering and forging steps were carried out at 1,150° C. for 15 minutes in an RX gas (an $H_2$-4$CN_2$-20CO mixture gas) in order to inhibit decarburization. While being thus heated, they were subjected to hot forging with an average pressure of 800 MPa, and thereafter were left to cool in air.

② On the other hand, sintered connecting rods were manufactured which were subjected to the above-described sintering but were not subjected to the forging. In this case, they were cooled at a rate of 100° C./min. after they were sintered in said RX atmosphere.

③ Moreover, as comparative examples, sinter forged connecting rods and sintered connecting rods which comprised the powder "A'" or the powder "B'" only were manufactured similarly by using the above-described process, respectively.

(2) Assessment on Connecting Rod

Figure 10:
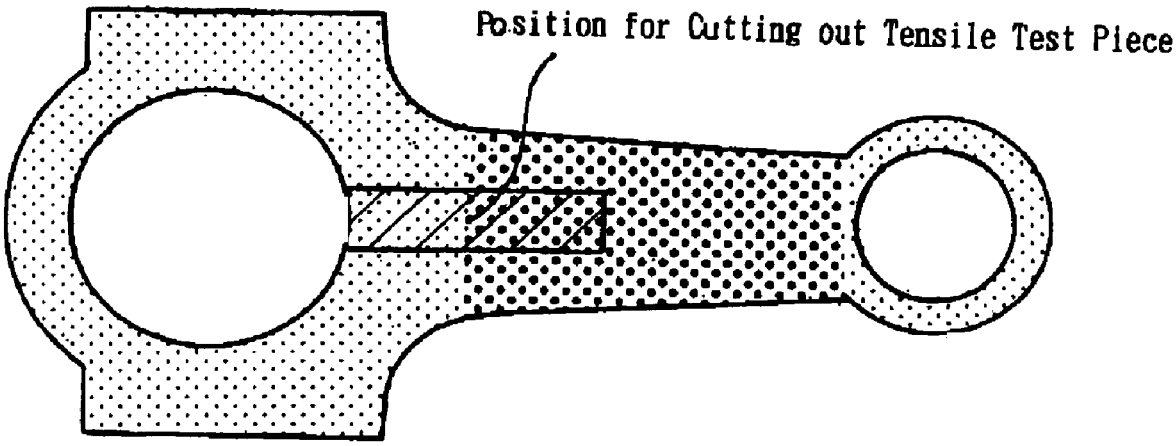
FIG. 10 is a schematic diagram for illustrating a part of the connecting rod from which a tensile test piece was cut out.

① The various connecting rods thus manufactured were subjected to a tensile test. Test pieces for the tensile test were collected from the portion illustrated in FIG. 10. The test pieces had a ϕ 4×20 mm parallel portion, and M8 chucks. Table 1 sets forth the results of the respective tests.

Note that, regarding the connecting rods which were manufactured by the powder "A'" and the powder "B'," the test-piece central portion was made as the boundary portion between both the powders, a strain gage was bonded to the powder "A'" (low-C powder) side and the powder "B'" (high-C powder) side, respectively, and then the tensile test was carried out.

② The following are apparent from the test results set forth in Table 1.

Namely, in all of the connecting rods which were manufactured by the powder "A'" and the powder "B'," the 0.2% proof stress at the respective portions was substantially identical with that of the connecting rods comprising only the powder which was used for the respective portions. The breaking stress was virtually the same as that of the connecting rods comprising the low-strength low-carbon powder (powder "A'").

Therefore, it is understood that the connecting rods manufactured by using the process according to the present invention was such that a variety of the powders did not exist in a mixed manner at the respective portions, distinct boundaries were formed, and the respective portions were formed with a desired composition.

③ Subsequently, regarding the sinter forged connecting rods, the actual fatigue strength was examined. Table 1 sets forth the test results as well.

The actual fatigue strength of said sinter forged connecting rods which were made by multi-material was identical with that of the sinter forged connecting rods comprising the high-carbon powder (powder "B'") only. This is believed to result from the fact that, although the sinter forged connecting rods which were made by multi-material had portions comprising only the low-carbon powder (powder "A'") at the big end or the small end, the column adjacent to the small-end side to be a dominant breaking section of connecting rods was formed of the high-carbon powder.

As can be understood from the present example, it was possible to make the strength and the processability or cost reduction compatible in one and only connecting rod by making the big end and small end which require processability with a composition with a reduced carbon content and making the column which requires high strength with a composition with an enlarged carbon content.

Thus, in accordance with the present process for filling a multi-powder or apparatus for filling a multi-powder, it is possible to fill powders whose constituent compositions differ into a cavity at once without disposing them in a mixed manner.

Moreover, in accordance with the present process for forming a multi-powder or apparatus for compacting a multi-powder, it is possible to efficiently produce compacts whose constituent compositions depends on the sections by using multi-powders after the filling.

TABLE 1

| | Type of Test Piece | | Alloy Composition | 0.2% Proof Stress (MPa) | Breaking Stress (MPa) | Actual Fatigue Strength (MPa) |
|---|---|---|---|---|---|---|
| Sintered Connecting Rod | Example | Multi-material Compacting | Fe—2Cu—0.6C (Powder "A": Low-carbon Side) | 408 | 510 | — |
| | | | Fe-2Cu-0.8C (Powder "B": High-carbon Side) | 470 | | |
| | Comp. Example | Single-material Compacting | Fe-2Cu-0.6C (Powder "A": Low-carbon Side) | 405 | 503 | |
| | | Single-material Compacting | Fe-2Cu-0.8C (Powder "B": High-carbon Side) | 466 | 575 | |
| Sintered-and-Forged Connecting Rod | Example | Multi-material Compacting | Fe-2Cu-0.6C (Powder "A": Low-carbon Side) | 642 | 852 | 380 |
| | | | Fe-2Cu-0.8C (Powder "B": High-carbon Side) | 708 | | |
| | Comp. Example | Single-material Compacting | Fe-2Cu-0.6C (Powder "A": Low-carbon Side) | 620 | 850 | 330 |
| | | Single-material Compacting | Fe-2Cu-0.8C (Powder "B": High-carbon Side) | 705 | 1000 | 380 |

The invention claimed is:

1. A process for filling a multi-powder, comprising the steps of:

moving a powder box, being disposed movably on a table and comprising a plurality of powder chambers, said powder chambers separated by partition plates on the inside of said powder box, storing a plurality of powders whose constituent compositions differ in a divided manner and having a bottom opening, onto a compacting die capable of forming a cavity into which the powders are filled; and filling a plurality of the powders into the cavity at once through the bottom openings by introducing a gas into the powder chambers to substantially equalize the respective flow resistances of a plurality of the powders, at least when the bottom openings are positioned above the cavity by the powder box moving step, wherein a gas flow Vg (mL/s) to be introduced into said powder chambers is such that an aeration value Vg/Vp, a ratio with respect to the volume Vp (mL) of the powders in the powder chambers, is from 0.1 to 0.3 (1/s) in each of said powder chambers, wherein said gas is introduced through an introducing hole disposed on the outer peripheral side of a gas feed pipe for feeding the gas into each of said powder chambers, and said gas feed pipe is disposed on the bottom side each of said powder chambers;

wherein said aeration value is set per each of said powder chambers; and wherein each of said powder chambers comprises a flow-resistance measuring device, wherein the flow resistance of said gas is measured independently in each of said powder chambers.

2. The process for filling a multi-powder set forth in claim 1, wherein said powders are ferrous powders whose major component is iron and average particle diameter is 250 μm or less.

3. A process for compacting a multi-powder, comprising the steps of:

moving a powder box, being disposed movably on a table and comprising a plurality of powder chambers, said powder chambers separated by partition plates on the inside of said powder box, storing a plurality of powders whose constituent compositions differ in a divided manner and having a bottom opening, onto a compacting die forming a cavity into which the powders are filled;

filling a plurality of the powders into the cavity at once through the bottom openings by introducing a gas into the powder chambers to substantially equalize the respective flow resistances of a plurality of the powders, at least when the bottom openings are positioned above the cavity by the powder box moving step; and producing a multi-powder compact by pressurizing a multi-powder comprising a plurality of the powders after the filling step, wherein a gas flow Vg (mL/s) to be introduced into said powder chambers is such that an aeration value Vg/Vp, a ratio with respect to the volume Vp (mL) of the powders in the powder chambers, is from 0.1 to 0.3 (1/s) in each of said powder chambers, wherein said gas is introduced through an introducing hole disposed on the outer peripheral side of a gas feed pipe for feeding the gas into each of said powder chambers, and a gas feed pipe for each of said chambers is disposed on the bottom side each of said powder chambers;

wherein said aeration value is set per each of said powder chambers; and wherein each of said powder chambers comprises a flow-resistance measuring device, wherein the flow resistance of said gas is measured independently in each of said powder chambers.

4. The process for filling a multi-powder set forth in claim 1, wherein said aeration value set is set to 0.15 (1/s).

5. The process for filling a multi-powder set forth in claim 1, wherein said gas is dry air or an inert gas, which does not oxidize said powders.

6. The process for filling a multi-powder set forth in claim 1, wherein said gas or said powders are heated.

7. The process for filling a multi-powder set forth in claim 1, wherein a gas supply source of said gas is a 0.4 MPA compressed air source.

8. The process for filling a multi-powder set forth in claim 7, wherein independent air compressors are adapted for said gas supply source.

9. The process for filling a multi-powder set forth in claim 7, wherein nitrogen gas cylinders are adapted for said gas supply source.

10. The process for filling a multi-powder set forth in claim 1, wherein each of said flow resistance measuring devices comprise a load, which comprises a probe with a strain gage.

11. The process for filling a multi-powder set forth in claim 8, wherein the flow resistances are controlled continuously or at predetermined intervals.

12. The process for filling a multi-powder set forth in claim 1, wherein said powders are subjected to a segregation prevention treatment.

* * * * *

UNITED STATES PATENT AND TRADEMARK OFFICE

CERTIFICATE OF CORRECTION

PATENT NO. : 7,175,404 B2
APPLICATION NO. : 10/475964
DATED : February 13, 2007
INVENTOR(S) : Mikio Kondo et al.

It is certified that error appears in the above-identified patent and that said Letters Patent is hereby corrected as shown below:

On The Title Page:
ITEM (75), line 3 should read Yoshitaka Takahashi, Toyota-shi (JP)

Signed and Sealed this

Thirty-first Day of July, 2007

JON W. DUDAS
*Director of the United States Patent and Trademark Office*